US007832480B1

(12) United States Patent
Fanguy

(10) Patent No.: US 7,832,480 B1
(45) Date of Patent: Nov. 16, 2010

(54) APPARATUS AND METHOD FOR EXTRACTING A TUBULAR STRING FROM A BORE HOLE

(76) Inventor: Robert P. Fanguy, 3507 Captain Cade Rd., Broussard, LA (US) 70518

( * ) Notice: Subject to any disclaimer, the term of this patent is extended or adjusted under 35 U.S.C. 154(b) by 78 days.

(21) Appl. No.: 12/217,845

(22) Filed: Jul. 8, 2008

(51) Int. Cl.
*E21B 29/00* (2006.01)

(52) U.S. Cl. ..... 166/298; 166/55; 166/85.1; 166/377

(58) Field of Classification Search ..... 166/55, 166/55.1, 298, 85.4, 85.1, 377; 251/1.3
See application file for complete search history.

(56) References Cited

U.S. PATENT DOCUMENTS

| | | | |
|---|---|---|---|
| 2,919,111 | A | 12/1959 | Nicolson |
| 4,043,389 | A | 8/1977 | Cobb |
| 4,240,503 | A | 12/1980 | Holt, Jr. et al. |
| 4,313,496 | A | 2/1982 | Childs et al. |
| 4,646,825 | A | 3/1987 | Van Winkle |
| 4,923,005 | A | 5/1990 | Laky et al. |
| 5,219,146 | A | 6/1993 | Thompson |
| 5,360,061 | A | 11/1994 | Womble |
| 6,543,546 | B2 | 4/2003 | Kaiser |
| 6,827,145 | B2 | 12/2004 | Fotland et al. |
| 6,834,721 | B2 * | 12/2004 | Suro ..... 166/297 |
| 7,021,381 | B1 | 4/2006 | Remedies et al. |
| 7,086,467 | B2 | 8/2006 | Schlegelmilch et al. |
| 7,143,626 | B2 | 12/2006 | Dole |
| 7,159,838 | B2 | 1/2007 | Champagene et al. |
| 2004/0003919 | A1 | 1/2004 | Johnson et al. |

* cited by examiner

*Primary Examiner*—Giovanna C Wright

(57) ABSTRACT

A tubular extraction system for use in a plug and abandonment process and may include a structural mounting for adaptation to a well head, various mountings may be used to provide a structure for attaching actuators for griping the tubular string, indenting or crimping the tubular and shearing the tubular string. The system further use a fork supported on a lifting apparatus such as a top drive unit, draw works or portable crane, the fork is inserted within the mounting structure of the system to engage the crimped or indented portion of the tubular section being extracted and thus allow removal of sequentially sheared sections of the tubular string.

24 Claims, 14 Drawing Sheets

APPARATUS AND METHOD FOR EXTRACTING A TUBULAR STRING FROM A BORE HOLE

1. FIELD OF THE INVENTION

The present invention relates generally to oil and gas wells and more specifically to a well head assembly and method for removing tubular from within a well bore during the well's abandonment process.

2. GENERAL BACKGROUND

In accordance with the general practice within the oil and gas exploration industry, wells are drilled into the earth in hopes of recovering oil and gas from reservoirs. The drilling process involves the process of installing pipe from the reservoir to the surface. To achieve this, a reinforcing wall is established in the earth in the form of a protective pipe liner called a tubular within the well bore. The casing, in descending diameters, extends in many cases to hundreds of feet and may be cemented in place to ensure a pressure-tight connection between the surface and the oil and gas reservoir. Often cement is placed within the annulus located between the descending diameters, thereby insuring continuity and pressure integrity.

Usually the tubular remains within the well bore until it has been determined that no oil or gas reservoirs have been found or the reservoir has been exhausted. In cases where the well is to be plugged and abandoned, current law requires that the tubular must be removed and disposed of in a safe manner. In other cases the well may simply need to be drilled in a different direction and, if for some reason the drill bit cannot pass through the previously installed tubular due to an obstruction, the tubular must be removed before drilling operations can be restarted.

Removing drill tubular is very difficult because of the tremendous weight of the tubular strings and, in some cases, cement is located around and between the casings. In most wells there are at least four tubular strings, beginning with the largest, upper and outer most conductor pipe, the surface casing, the intermediate tubular and finally the production casing.

The plugging and abandonment of a well generally begins, in many cases, by first inspecting the well and insuring that the well is inactive and free of any residual gas and that the well is safe for removing the blow out preventors, well head, etc., above the tubing hangers. A safe work platform is established around the well head and various equipment is then used to create a bridge plug within the production tubular at a prescribed depth and applying cement thus sealing or plugging the well casing. The tubular is then cut at a prescribed depth below the surface using chemical cut, jet cut, etc., and a lifting device is then attached to the inner most tubular by screwing into or spearing the tubular tubing hanger. The production tubular is then lifted to a desired length, usually approximately forty feet, where either slips are set to hold the string and tongs are used to uncouple the tubular joints, or, two diametrically opposing holes are cut in the casing. In the latter case a bar is then inserted through the holes and the lifting device, such as a crane, is slaked off until the bar rests on top of the well flange. The tubular is then cut just above the bar and the initial section of tubular is then removed. The crane then returns and is attached to the bar thus lifting the tubular string for another length and holes are again cut for a lifting bar. The process is repeated until the tubular is removed. The process is then repeated for each tubular string until all of the casings have been removed. In some cases, where cement is present between the tubular strings, it becomes necessary to chip away the cement in order to cut the lifting bar holes.

Each incremental section of tubular usually requires operators to cut the casing, usually by torch, and manually drill two holes. The two holes are drilled from each side of the tubular in an attempt to keep them aligned with each other. It is essential that the holes be aligned with each other or large enough so that the bar or rod can be placed through the two holes. As discussed above, raising the tubular requires an extensive amount of force to overcome the resisting forces. Therefore, a stable platform is required. After the various increments of tubular are cut and pulled from the well bore, they are disposed of in a prescribed manner.

Holes drilled for the bar are individually and sequentially drilled in each incremental section of casing. The operators usually drill one side at a time, a slow and tedious process, especially with heavy gauge pipe. In some cases up to two hours is required. The operator is required to drill a second hole that is diametrically opposite the first. In some cases the operator is fortunate enough to get the two holes lined up, but at other times the two holes did not line up and a bar could not be inserted through both holes in which case a torch is used to enlarge at least one of the holes so that the bar could be placed through both holes.

A dual drill system that drills holes from both sides simultaneously thereby insuring alignment may be used. Although the time required to drill the holes may be drastically reduced, a significant amount of time is still required to set up, and clear, lubricate and repair the drill bits. In addition, a torch is still often used to cut each section of the tubular being removed. Since a torch is used to separate the tubular into reasonable lengths, it has become more prevalent to simply cut the holes with a torch as well.

In view of the above process a faster, more efficient method is needed to perform this task with greater certainty.

While certain novel features of an embodiment of this invention are described below and pointed out in the drawings and annexed claims, the invention is not intended to be limited to the details specified herein, since a person of ordinary skill in the relevant art will understand that various omissions, modifications, substitutions and changes in the forms and details of the device illustrated and in its operation may be made without departing in any way from the scope of the present invention. No feature of the invention is critical or essential unless it is expressly stated as being "critical" or "essential."

3. SUMMARY

A method and apparatus for the extraction of a tubular string such as casing from an earth bore hole such as in a well plug and abandonment process is provided. An embodiment of the present apparatus and method by providing a system for griping the tubular string, indenting or crimping the tubular and shearing the string without using a torch. In an embodiment a fork, having a bail for connection to a lifting device such as a crane, is inserted within the structure of the tubular removal apparatus to engage the crimped portion of each tubular section and thus remove each sequentially sheared section. The tubular removal apparatus is located above the tubular string to be extracted and may be configured using a mounting that may be suspended, supported by a structure or mountable to a wellhead. The apparatus can be used on land or offshore, manned or unmanned wells and adapted for any size tubular string. Lifting force may be provided by a tubular jack, top drive unit, draw works or portable crane or any other suitable apparatus.

These and other objects, features, and advantages of the present invention will become apparent from the drawings, the descriptions given herein, and the appended claims. The drawings constitute a part of this specification and include exemplary embodiments to the invention, which may be embodied in various forms.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE EMBODIMENT DESCRIBED IN THE DRAWINGS

Figure 1:
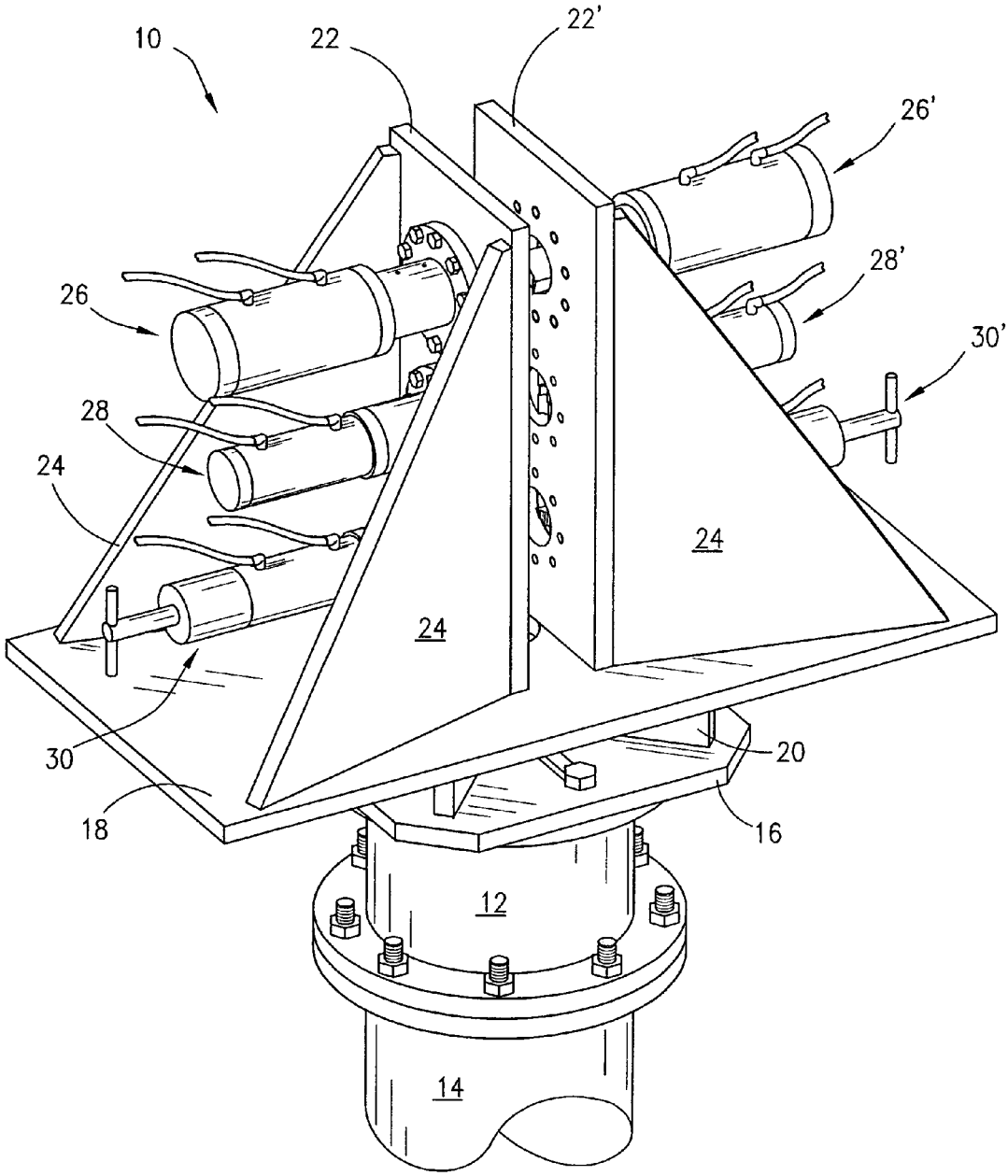
FIG. 1 is an isometric view of an embodiment of the tubular removal system with a wellhead assembly.

As may be seen in FIG. 1, the tubular extraction or removal system 10 is a structural mounting, which may be supported in any number of ways over a tubular string to be extracted. Applicant anticipates that an actuator mounting may be supported by an existing structure, suspended, or supported utilizing a variety of support frame configurations utilizing structures using legs etc. Applicant also anticipate that even the mounting assembly 10 itself may be configured in any number of ways for attaching the actuators 26,26', 28,28' and 30,30' in a manner whereby the actuators are opposing each other so as to allow the gripping, indenting and shearing of a tubular string passing there between. Therefore, the structures illustrated herein are not intended to be restrictive in any way. One example of such a mounting is shown in FIG. 1 where a mounting assembly 10 is attached and supported by a wellhead adaptor assembly such as a tubular hanger or flanged adaptor spool 12 and or wellhead assembly 14 utilizing an adaptor plate 16. Adaptor plate 16 is spaced apart from the mounting base plate 18 by spacer bars 20 and is slotted between the spacer bars 20 to allow bolted connection to various sizes of hanger or well head assembly flanges. The tubular removal assembly 10 may be configured for a range of tubular sizes, adjustable to accommodate each tubular size or made size specific. For the purpose of this disclosure, the assembly shown herein is a size specific configuration. Structural assembly 10 further includes a pair of opposing mounting plates 22 and 22' attached perpendicular to the base plate 18 opposite the adaptor plate 16. Gusset plates 24 are attached to the mounting plates 22, 22' and the base plate 18 for support. Mounting plates 22 and 22' are bored and tapped for flange mounting actuator assemblies 26,26', 28,28' and 30, 30'.

Figure 2:
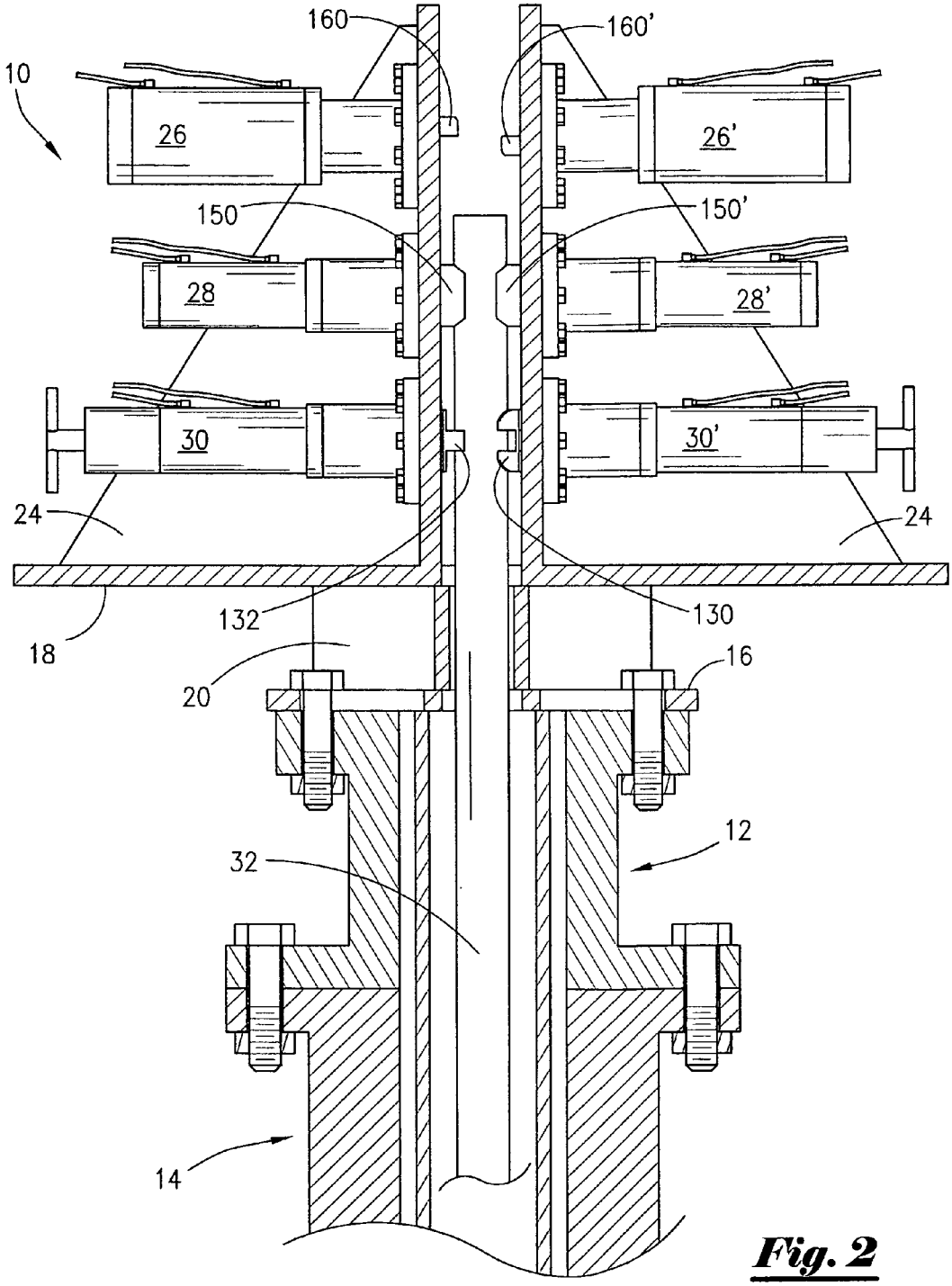
FIG. 2 is a cross-section an embodiment of the assembly seen in FIG. 1.

A tubular string 32 being extracted from within the well via the wellhead 14 and/or tubular hanger assembly 12 using the tubular removal assembly 10, as seen in FIG. 2, anticipates the end of the tubular string 32 being exposed above the surface of the well head after removal of the wellhead valves, etc., or upon attachment to the tubular string by a lifting apparatus such as crane or winch. In cases where the tubular strings are cemented in place, tubular jacks may be employed or other methods commonly employed for separating the tubular strings. The inner most tubular string is then lifted to a position at least above the level of the indenting actuators 28, 28'. This allows the gripping actuators 30, 30' to be activated and thus engage the casing, thereby retaining the tubular string and preventing the tubular string from falling back into the well. The tubular attachment used for lifting the string initially may now be removed. The indenting actuators 28, 28' are then activated, thereby forming an indentation in the surface of the tubular. Such indentations may be in the form of a crimp, swage, or any other form deformation in the tubing surface. The indenting actuators 28, 28' are retracted once the deformations or indentations in the tubular have been formed.

Figure 3:
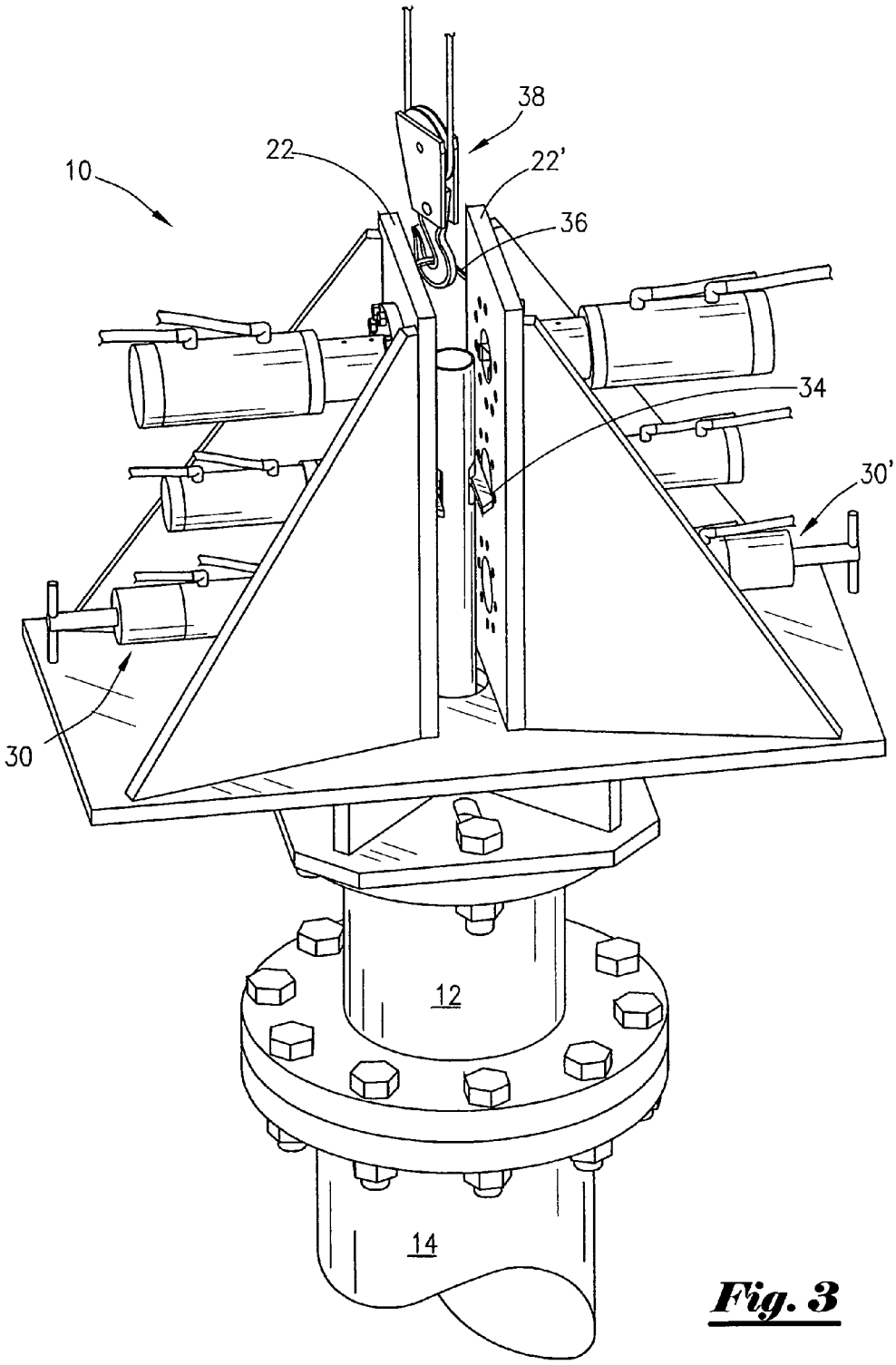
FIG. 3 is an isometric view of an embodiment of the tubular removal system and lifting means.

Looking now at FIG. 3, we see that an embodiment of the tubular removal system includes a lifting device cooperative with the indentations or deformations made in the tubular members, such devices, may include releasable collars or hinged or pivotal tongs capable of being inserted between the opposing actuators for engaging and securing the tubular members. One example of such devices is the fork 34 having a pivotal bail 36 suspended from a cable attached to a lifting apparatus 38 such as a crane or winch. The fork assembly 34, further detailed in FIGS. 24-27, is positioned between the actuator mounting plates 22, 22' engaging the indentations 40 formed on each side of the tubular 32 by the indention actuator assemblies 28, 28'. The tubular 32 is retained within the fork assembly 34 by a safety bar 42 extending across the longitudinal slot 37 within the elongated plate 35.

Figure 4:
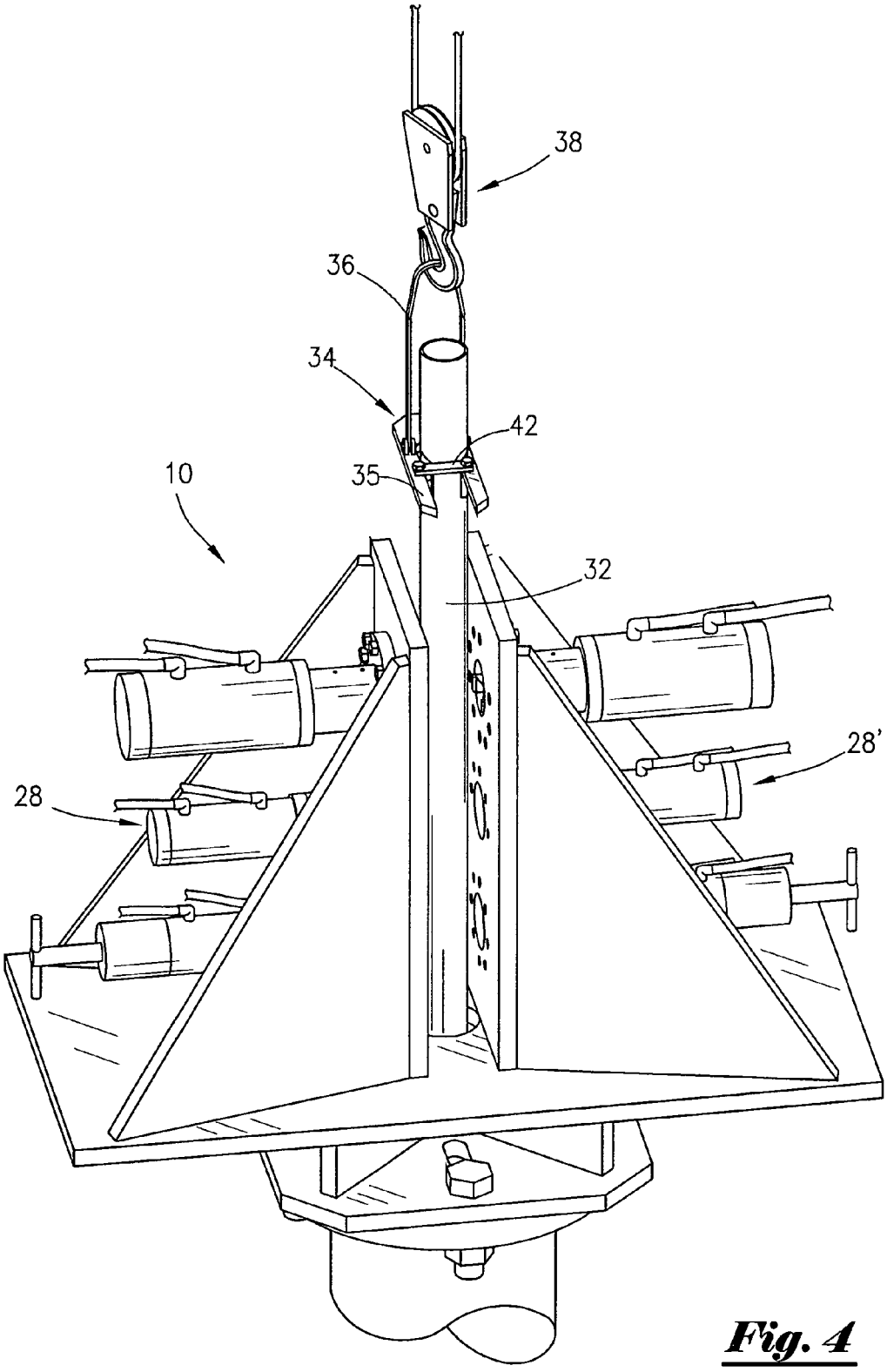
FIG. 4 is an isometric view of and embodiment of the tubular removal system wellhead assembly and lifting means showing tubular extraction.

As shown in FIG. 4, with the fork assembly 34 engaging the tubular string 32, the gripping actuator assemblies may be retracted, thereby allowing the weight of the tubular string 32 to be supported by the fork assembly 34 and the lifting means 38.

Figure 5:
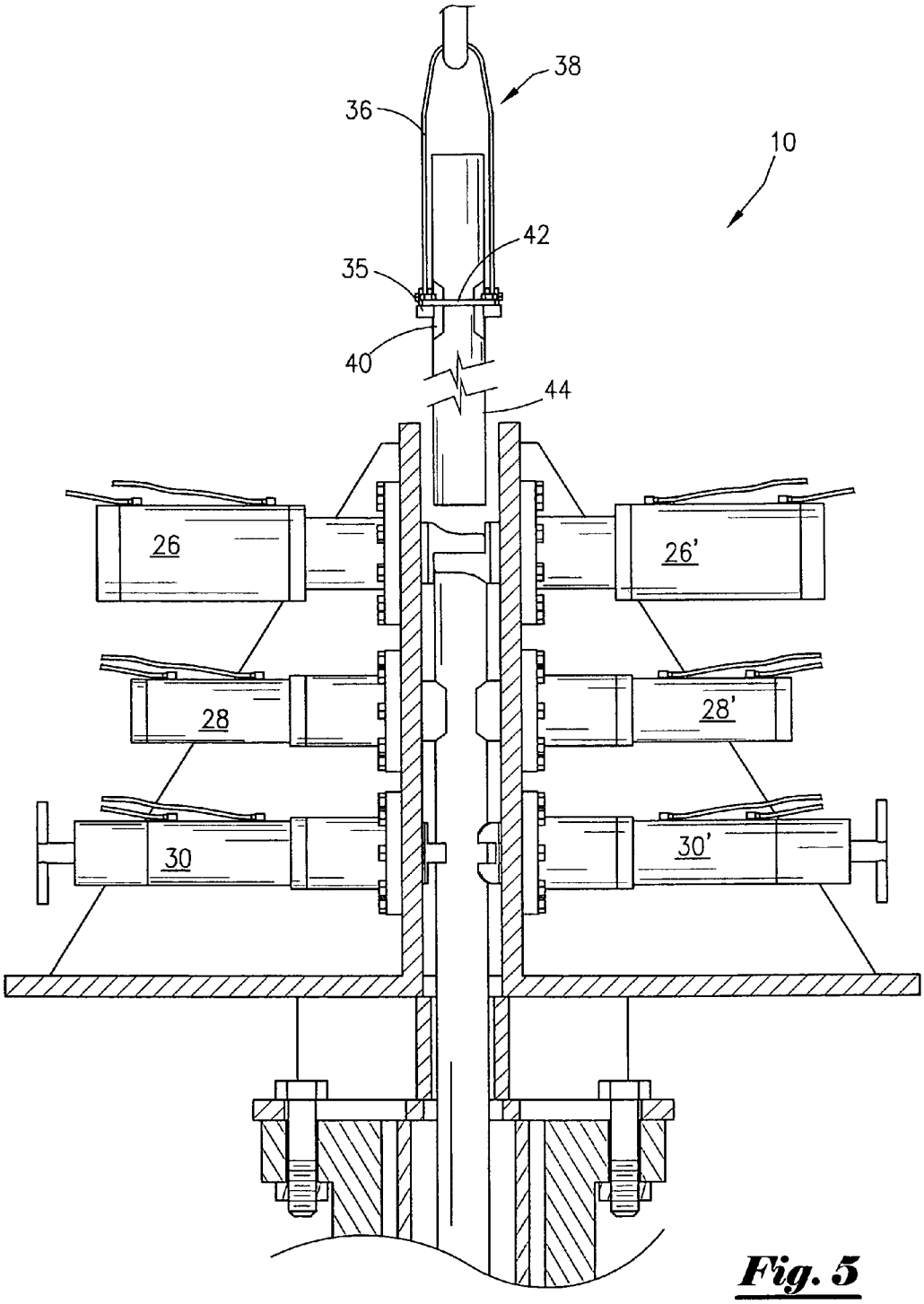
FIG. 5 is a cross-section view of an embodiment of the tubular removal system lifting means showing tubular gripping, indenting, and shearing operations.

Elevating the lifting means 38 withdraws a portion of the tubular string from the well. When a desired length of the tubular string is exposed above the tubular removal assembly 10, usually about thirty-five to forty feet, the gripping actuators are reactivated, thereby retaining the tubular string, and the indenting actuators are reactivated, forming indentations 40 in the tubular string, and shearing actuators 26, 26' are activated, thus shearing the casing. A number of method may be used to shear the tubular members such as, interchangeable shearing dies attached to hydraulic piston actuators, cutting torches, saws, water jets and other processes capable of separating a length of tubular. In any case when a length of the tubular is fully separated, for example using the shearing actuators 26, 26' the shears are fully retracted and the sheared section of tubular 44 may then be removed from the vicinity of the tubular removal assembly 10, as shown in FIG. 5. The process is repeated until the desired length of each tubular string is removed from the well bore.

Figure 6A:
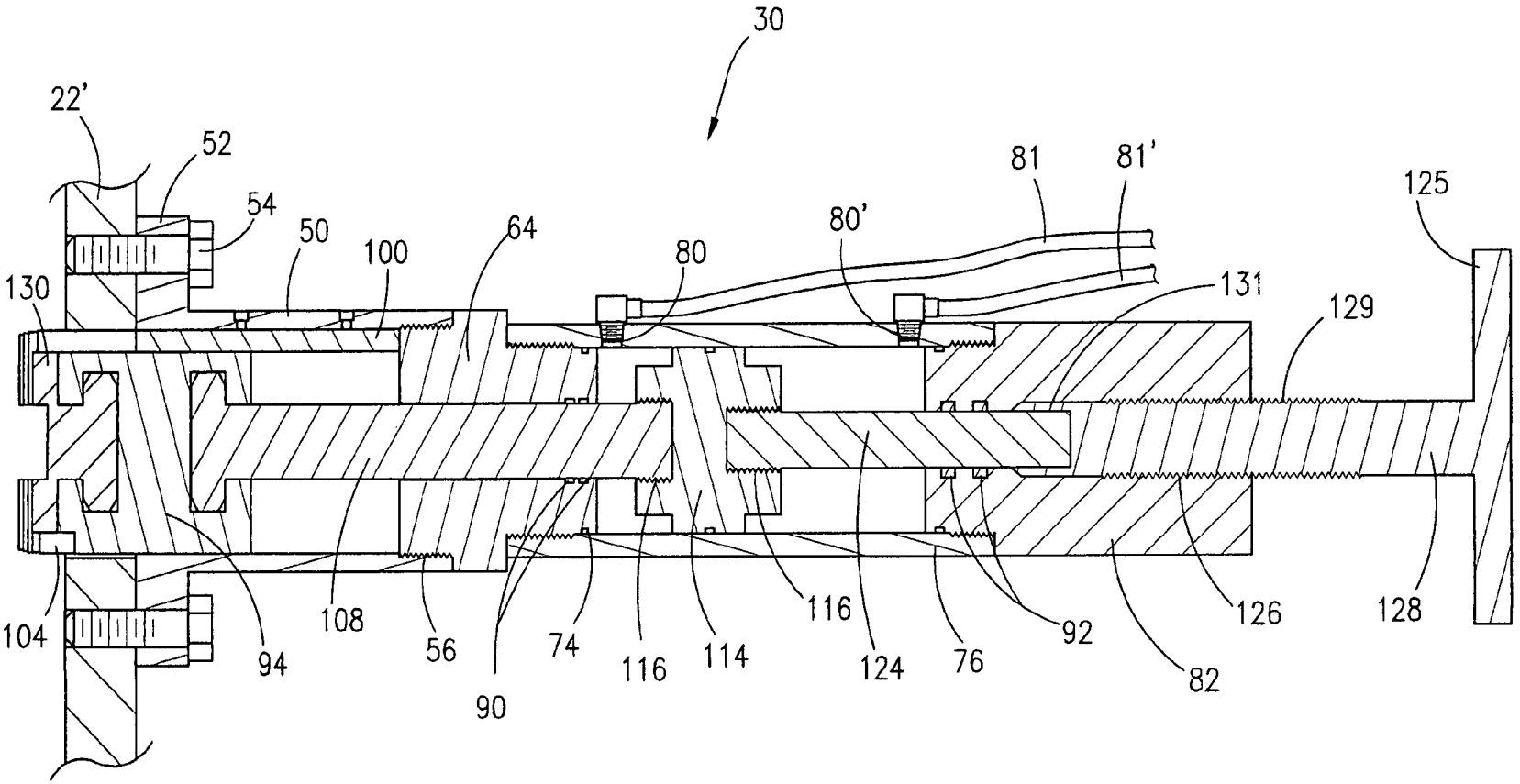
FIG. 6A is a cross-section view of an embodiment of the gripping die actuator with manual stop.
Figure 6B:
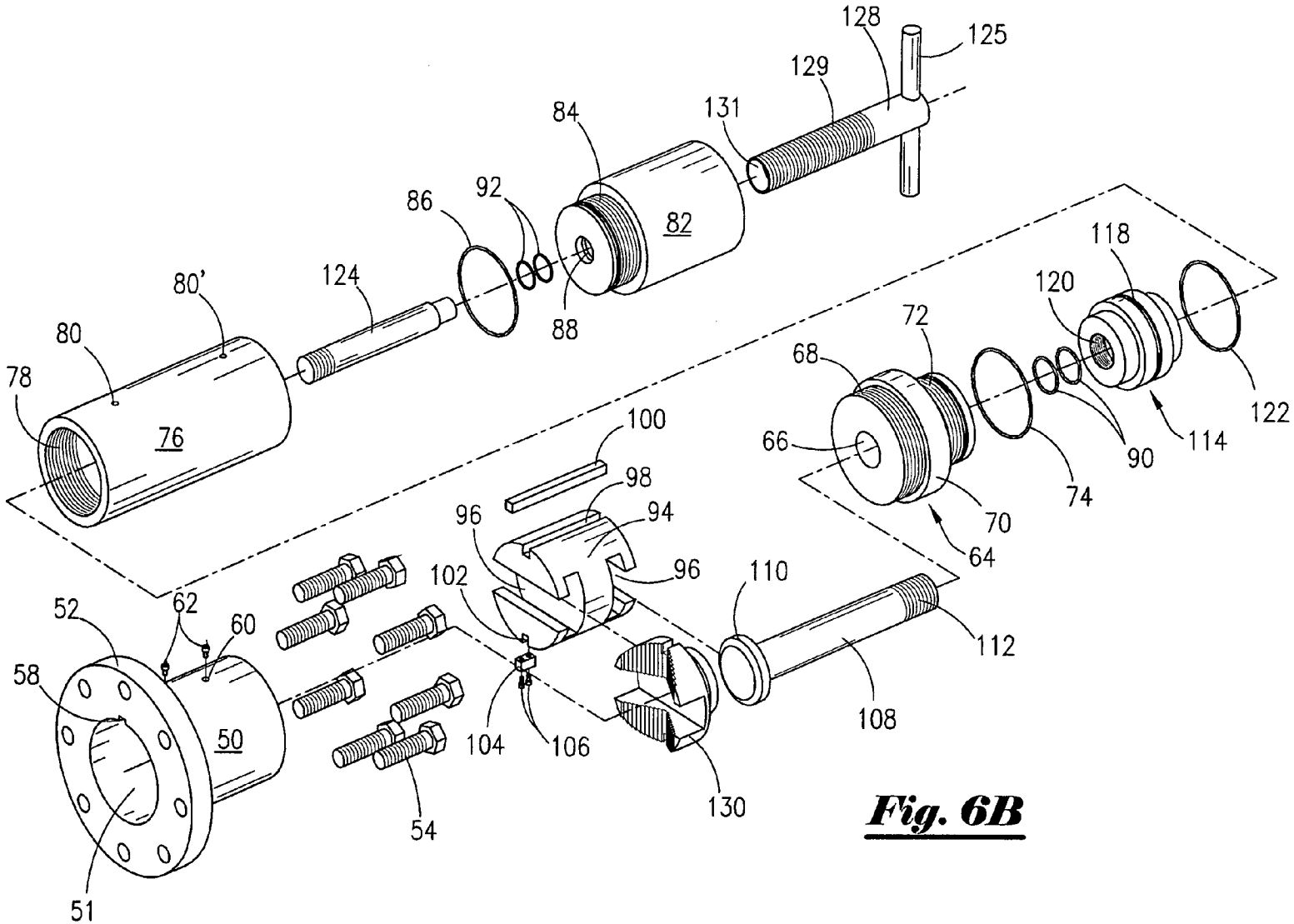
FIG. 6B is an exploded view of an embodiment of the gripping die actuator with manual stop.

As seen in FIG. 6A and in more detail in FIG. 6B, the drawings taken together illustrate the tubular gripping actuator assemblies 30 and 30'. Each actuator assembly 30, 30' includes a first tubular hub member 50 having an internal bore 51 and a mounting flange 52 at one end having holes therein for attachment to the actuator mounting plates 22, 22' with bolts 54. Tubular hub member 50 also includes internal threads 56, seen in FIG. 6A, located at the end opposite the flange, and an internal keyway 58, threaded holes 60, and set screws 62 located and in communication with the keyway 58. A cylinder head 64, having a central longitudinal bore 66 and external threads 68 at one end cooperative with the internal threads 56 in the first tubular member 50, a shoulder portion 70, external threads 72 at the opposite end, and an o-ring seal 74. A tubular cylinder body 76 having internal threads at each end is threadably secured to one end of the cylinder head 64 with cooperative threads 78. Porting 80, 80' provides fluid communication via fluid tubing 81 with the cylinder body 76. A butt member 82 having threads 84 at one end is threadably secured to the cylinder body 76 and sealed therein by an o-ring seal 86. The butt member 82 associated with the special gripping actuator, 30, 30', shown in FIG. 6A, also has a central longitudinal bore and internal threads located opposite the threads 84 and internal o-ring grooves and o-rings 92, seen in FIG. 6B. The gripping actuator assemblies 30, 30' further include a connector member 94 slidable within the flange head 50 having a "C" shaped transverse channel or slot 96 at each end, an external longitudinal keyway 98 and key 100 cooperative with keyway 58 located in the flange head 50, and a notch 102 opposite the keyway 98 for inserting a tie bar 104. The notch 102 also has an internal threaded hole for receiving a screw 106 for passing through the tie bar 104. Other means for preventing rotation of the connector member 94 relative to the flange head 50 and retaining die members within the "C" shaped slots are anticipated, such as flats or other geometrical shapes. The actuator 30, 30' in FIGS. 6A, 6B also includes a connecting rod 108 slidable within the bore 66 of the cylinder head 64 and has a mushroom head 110 cooperative with the "C" shaped slot 96 at one end and external threads 112 at the opposite end. The connecting rod 108 is sealed as it passes through the bore 66 with internal O-ring grooves and seals 90. A cylindrical piston 114, slidable within the cylinder barrel 76, has an internal bore 120 internally threaded at each end 116, one end of which is cooperatively threaded with threaded portion 112 of the connecting rod 108. The piston 114, having an intermediate shoulder portion 118, also has a sealing means 122 recessed therein that is in sliding contact with the internal bore of the cylinder barrel 76. An embodiment of the gripping actuators 30, 30' has a piston limiting or stop is provided that includes a stop rod 124 threadably engaging threads 116 within the piston 114 opposite the cylinder rod 108. The stop rod 108 is slidable and rotatable within the optional bore 88 in the cylinder butt member 82 and sealed therein by o-rings 92. The cylinder butt member 82 also has internal threads 126, as seen in FIG. 6A located opposite its external threads 84 for engagement with a "T" bar, piston stop, handle assembly 128 having a transverse bar 125 at one end, a threaded portion 129 and a socket 131 for receiving one end of the stop rod 124 in a supporting and rotatable manner. The stop rod 124 may be used to prevent reverse travel of the piston 114 in the event of fluid power failure to the gripping actuators 30, 30' or when the tubular string must be suspended using the gripping dies for an extended period of time. With the gripping dies set and holding the tubular string in suspension within the well, the stop handle 128 may be rotated until the piston limiting rod 124 is engaged, thus preventing reverse travel of the piston 114.

Figure 7A:
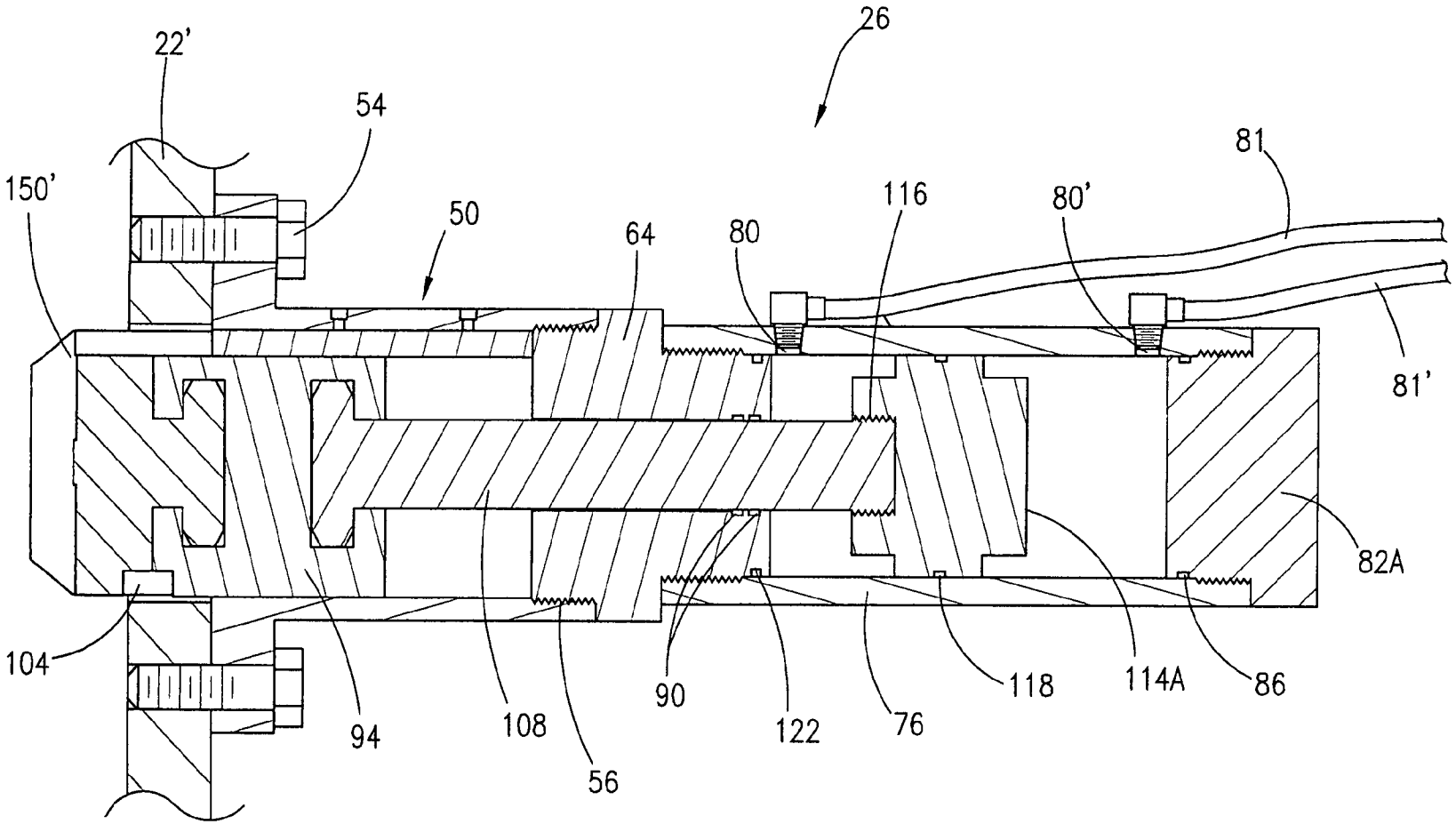
FIG. 7A is a cross-section view of an embodiment of the indenting and shearing die actuators.
Figure 7B:
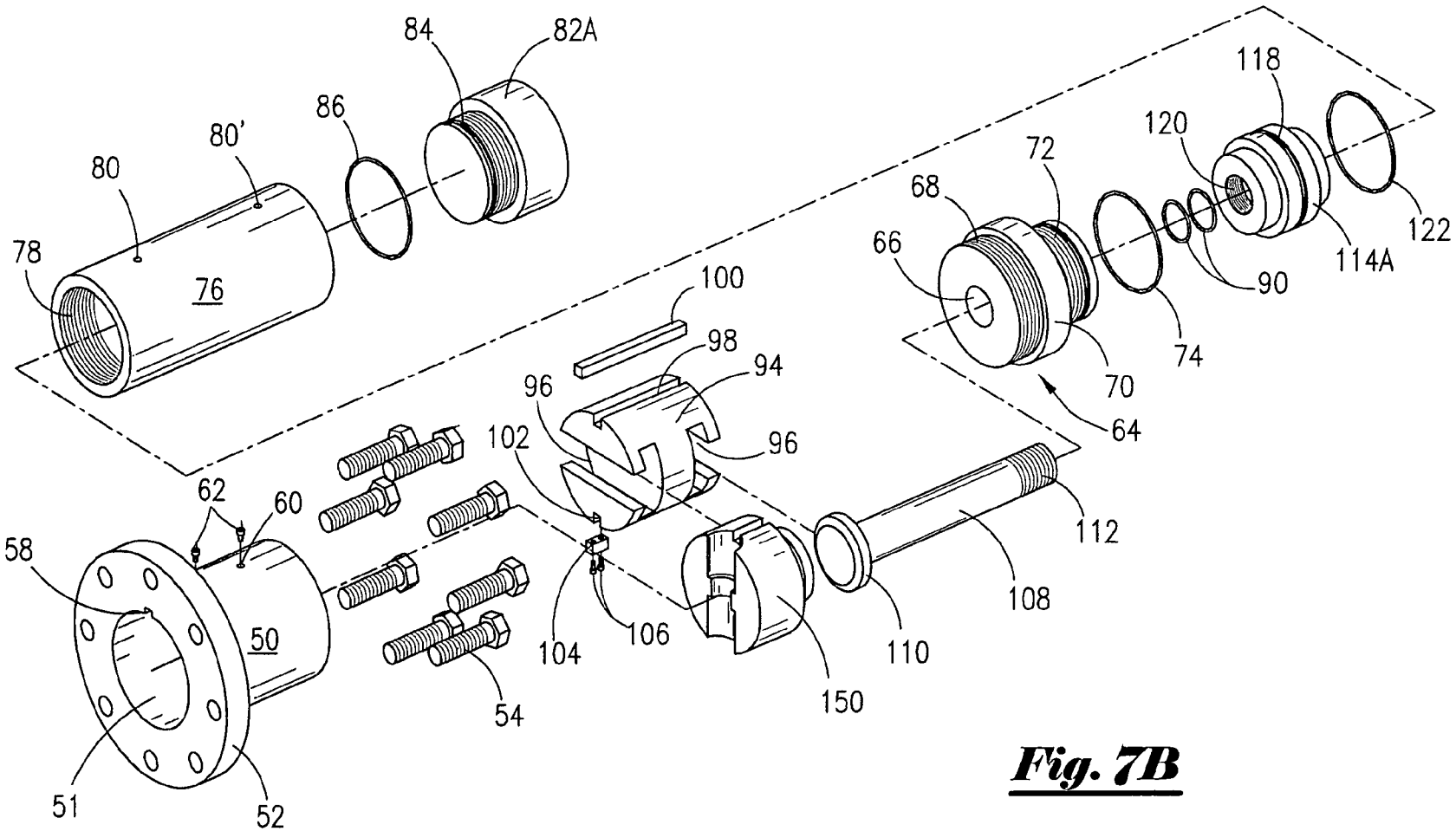
FIG. 7B is an exploded view of an embodiment of the indenting and shearing die actuators.

Typically the crimping or indenting actuators 26, 26' and the shear actuators 28, 28' are essentially the same as shown in FIG. 7A and FIG. 7B and when taken together fully detail the assembly. These assemblies are generally the same except for size as the gripping actuators 30, 30' discussed above except for the piston limiting or stop arrangement. In this case, each actuator 26, 26' and 28, 28' includes a first tubular member 50 having an internal bore 51 and a flange 52 at one end having holes therein located on a standard flange bolt circle for attachment to the actuator mounting plates 22, 22' with bolts 54. Tubular member 50 also includes internal threads 56, seen in FIG. 7A, located at the end opposite the flange 52 and an internal keyway 58, threaded holes 60, and set screws 62 located and in communication with the keyway 58. A cylinder head 64 has a central longitudinal bore 66 and external threads 68 at one end cooperative with the internal threads 56 in the first tubular member 50, a shoulder portion 70, external threads 72 at the opposite end, and an o-ring seal 74. A tubular cylinder body 76 having internal threads at each end is threadably secured to one end of the cylinder head 64 with cooperative threads 78. Porting 80, 80' provides fluid communication via fluid tubing 81 with the cylinder body 76. A butt member 82A, having threads 84 at one end, is threadably secured to the cylinder body 76 and sealed therein by an o-ring seal 86. The actuator assemblies further include; a connector member 94 slidable within the flange head 50 having a "C" shaped transverse slot 96 at each end, an external longitudinal keyway 98 and key 100 cooperative with keyway 58 located in the flange head 50, and a notch 102 opposite the keyway 98 for inserting a tie bar 104. The notch 102 also has an internal threaded hole for receiving a screw 106 for passing through the tie bar 104. Other means for preventing rotation of the connector member 94 relative to the flange head 50 and retaining die members within the "C" shaped slots 96 are anticipated, such as flats or other geometrical shapes. The actuators 26, 28, in FIG. 7A also include a connecting rod 108 slidable within the bore 66 of the cylinder head 64 and having a mushroom head 110 cooperative with the "C" shaped slot 96 at one end and external threads 112 at the opposite end. O-ring seals 90 also seal the connecting rod 108 as it travels through the cylinder bore 66. A cylindrical piston 114A, slidable within the cylinder barrel 76, has an internal bore 120 that is internally threaded 116 at one end and is cooperative with a threaded portion 112 of the connecting rod 108. The piston 114 also has an intermediate shoulder portion 118, with a sealing means 122 recessed therein, in sliding contact with the internal bore of the cylinder barrel 96.

Figure 8:
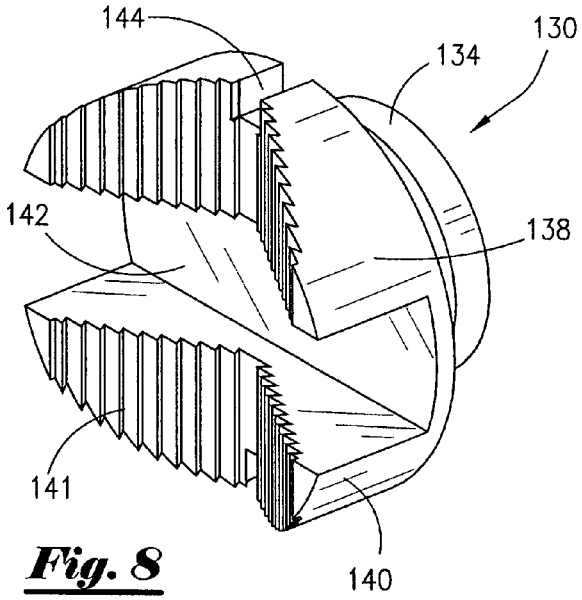
FIG. 8 is a frontal isometric view of an embodiment of the first member of the gripping die-set.
Figure 9:
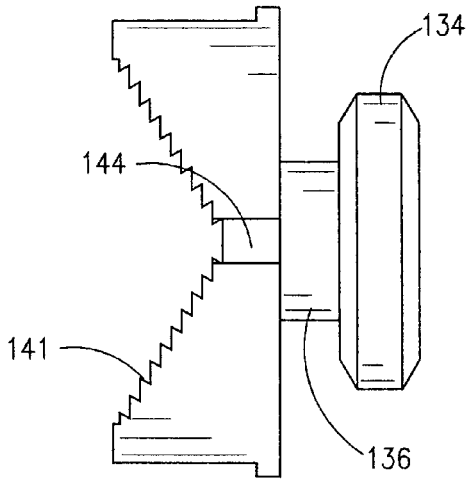
FIG. 9 is a top view of an embodiment of the first member of the gripping die-set.
Figure 10:
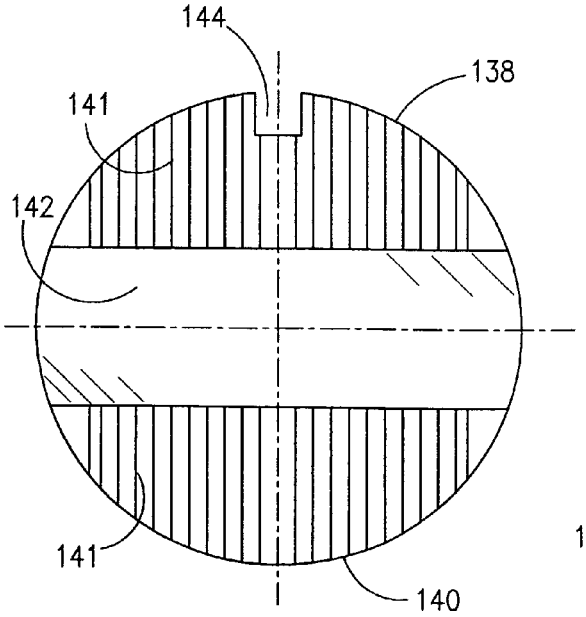
FIG. 10 is an end view of an embodiment of the first member of the gripping die-set.
Figure 11:
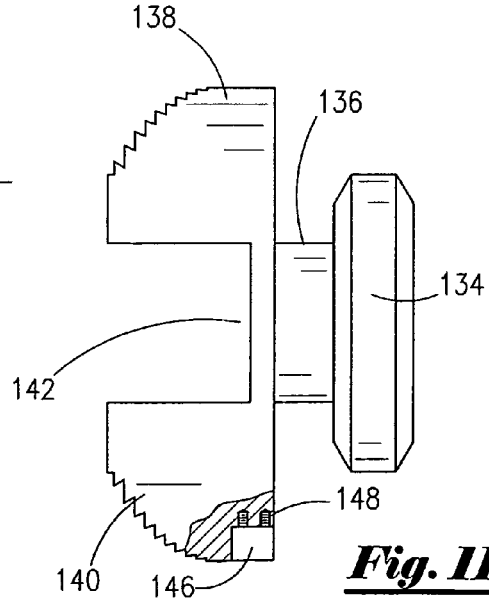
FIG. 11 is a side view of an embodiment of the first member of the gripping die-set.

Turning back to FIG. 2 we see that the gripping actuators are fitted with a gripping die-set composed of two opposing die set elements 130 and 132. These dies are better seen in FIGS. 8-11. One of the die set members 130, 132 is interchangeably fitted to the connector member 94 of each of the gripping actuators 30, 30' and fixed thereto by a tie bar 104 and a retaining screw 106, as seen in FIGS. 6A, 6B. The gripping die member 130, seen in FIG. 8, is diametrical, one end of which is configured with a mushroom head 134 at one end of a stem portion 136, best seen in FIG. 9, the mushroom head 134 being cooperative with the "C" shaped slot in the connector 94. The opposite end of the cylindrical die has an upper "V" shaped jaw portion 138 and a lower "V" shaped jaw portion 140, each with vertical teeth 141. A channel 142 along the horizontal centerline divides the jaws 138,140. The upper jaw portion 138 contains a keyway 144 cooperative with key 100, best seen in FIG. 10, located on the vertical centerline. As shown in FIG. 11, the lower jaw portion contains a notch 146 located on the vertical centerline cooperative with the tie bar 104 and a threaded hole 148 for a screw 106. The tie bar 104 and the key 100 residing in the keyway 144 and notch 146 insure orientation of the die member 130 relative to the connector 94.

Figure 12:
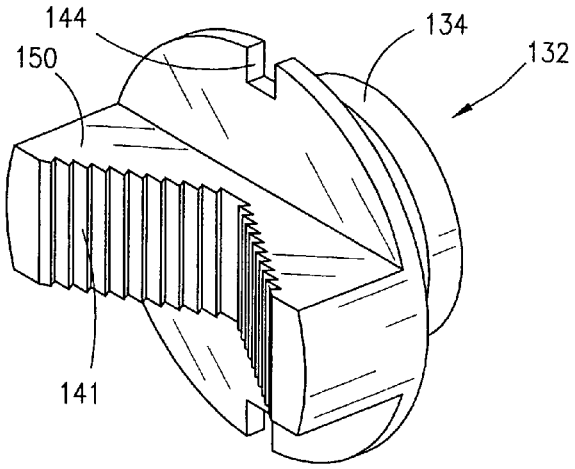
FIG. 12 is an isometric view of an embodiment of the second member of the gripping die-set.
Figure 13:
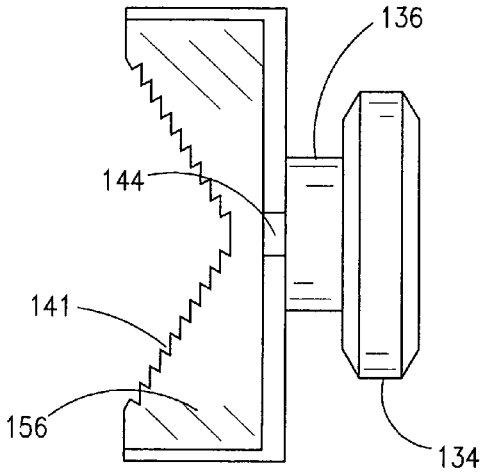
FIG. 13 is a top view of an embodiment of the second member of the gripping die-set.
Figure 14:
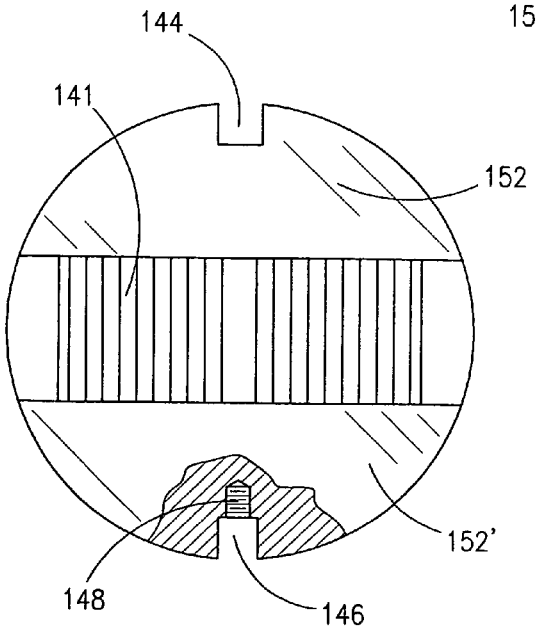
FIG. 14 is an end view of an embodiment of the second member of the gripping die-set.
Figure 15:
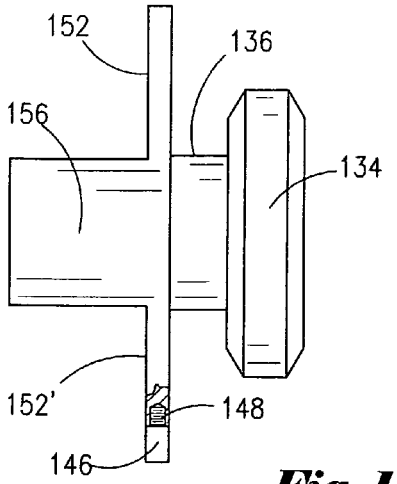
FIG. 15 is a side view of an embodiment of the second member of the gripping die-set.

The opposing gripping die-set member 132 as detailed in FIGS. 12-15, utilizes some of the same elements as seen in gripping die-set member 130, i.e. the mushroom head 134 and stem 136; however, in this embodiment, the gripping die member 132, seen in FIG. 12, is diametrical, one end of which is configured with a mushroom head 134 at one end of a stem portion 136, best seen in FIG. 13, the head 134 being cooperative with the "C" shaped slot in the connector 94. The opposite end of the diametrical die member 132 has a centrally located horizontal "V" shaped jaw portion 150 with vertical teeth 141. The central jaw portion 150 extends above the faces 152,152' of the die member 132, as better shown in FIG. 14 and FIG. 15. A notch 146 is also provided, located on the vertical centerline cooperative with the tie bar 104 and a threaded hole 148 for a screw 106, seen in FIG. 14. The tie bar 104 and the key 100 residing in the keyway 144 and notch 146 insures orientation of the die member 130 relative to the connector 94. Dies 130 and 132 provide a positive grip on the surface of the tubular over a range of sizes when the actuators 30 and 30' are activated in unison.

Again looking back at FIG. 2, we see that the crimping or indenting actuators 28, 28' are fitted with an indenting or crimping die-set composed of two opposing elements 150 and 150'. It is anticipated that various die configurations may be used to reduce the diameter of the tubular so as to produce a groove like area in the surface of the casing. An embodiment showing a groove or channel ring around the tubular illustrates a way to provide better accessibility and retention by a lifting fork. An embodiment of dies are better seen in FIGS. 16-19. One of the die set members 150, 150' is interchangeably fitted to the connector member 94 of each of the indenting actuators 28, 28' and fixed thereto by connecting bar 104 and a retaining screw 106.

Figure 16:
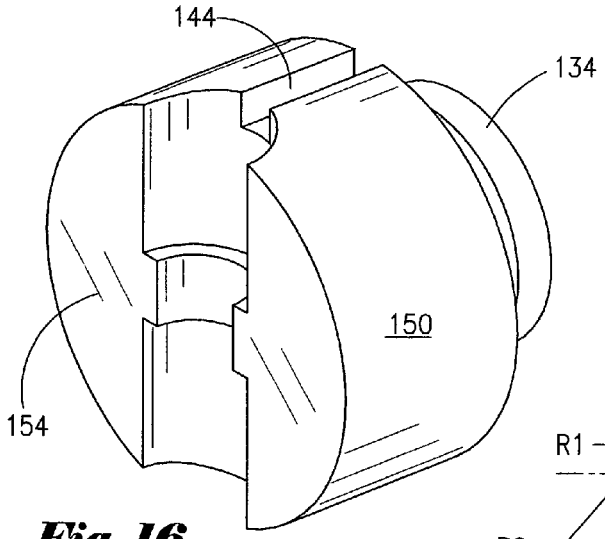
FIG. 16 is an isometric view of an embodiment of the first and second members of the indenting die-set.
Figure 17:
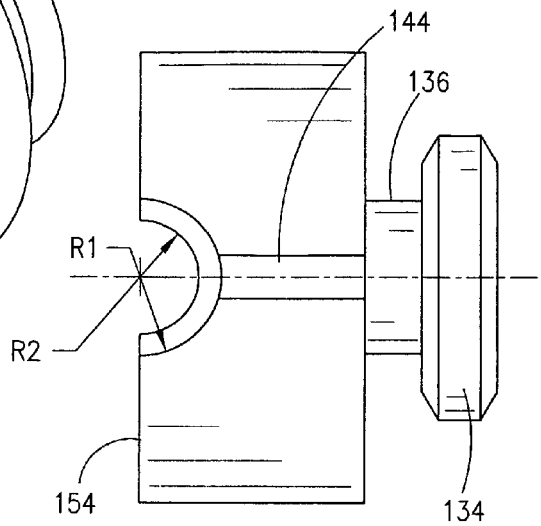
FIG. 17 is a top view of an embodiment of first and second members of the indenting die-set.
Figure 18:
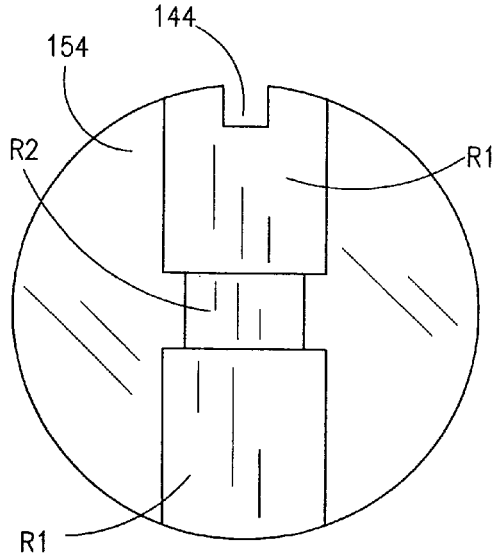
FIG. 18 is an end view of an embodiment of first and second members of the indenting die-set.
Figure 19:
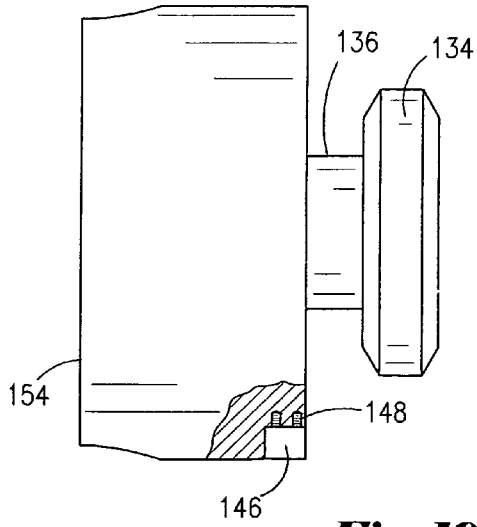
FIG. 19 is a side view of an embodiment of first and second members of the indenting die-set.

As may be deduced by viewing FIG. 16, an embodiment of the indenting die members 150, 150' are identical, each being one half of the dies-set. Therefore, only one half of the set is being shown. Again the die is cylindrical with a stem portion 136 and a mushroom shaped head 134 at one end and an upper keyway 144 and a lower tie-bar notch 146 and threaded hole 148. The face 154 of each indenting die half represents the vertical centerline of the tubular to be engaged by the dies 150, 150', shown in FIG. 17. an embodiment of each die half has a vertical bore having upper and lower radii $R_1$ equal to one-half of the tubular outside diameter to be engaged by the dies. Smaller radii $R_2$ centrally located intermediate the upper and lower radii $R_1$, shown in FIG. 17 and FIG. 18, provides an indentation or crimped area on each side of the tubular being engaged when the indenting actuators are engaged in unison. An embodiment of the dies are attached to the connector 94 by the tie bar 104 and screw 106 cooperative with the notch 146 and threaded hole 148, shown in FIG. 19, for additional orientation.

Figure 20:
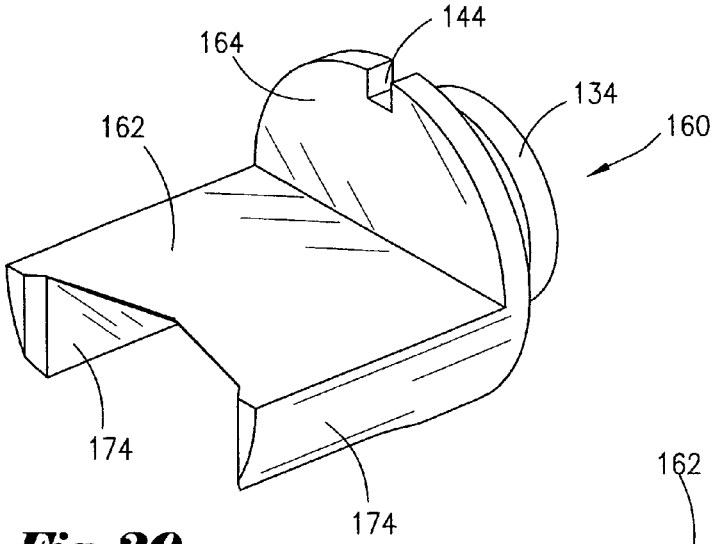
FIG. 20 is an upper isometric view of an embodiment of one of the shear die-set members.
Figure 22:
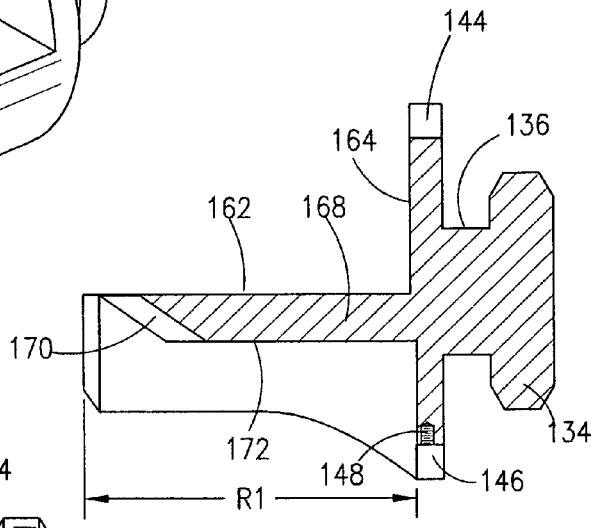
FIG. 22 is a cross-section view of an embodiment of the members of the shear die-set taken along sight lines 22-22 seen in FIG. 21.
Figure 21:
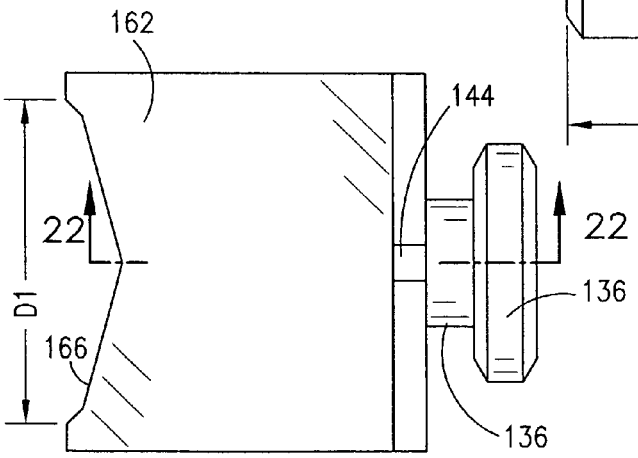
FIG. 21 is a top view of an embodiment of one of the shear die-set members.
Figure 23:
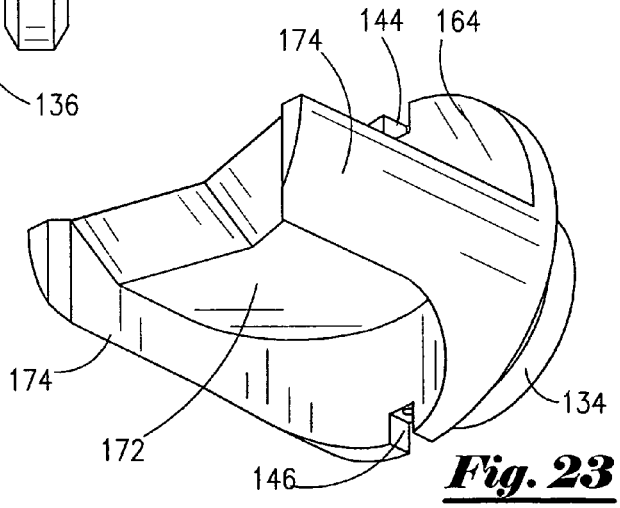
FIG. 23 is a lower isometric view of an embodiment of the die members of the shear die-set.

Returning again to FIG. 2, we see that the shearing actuators 26, 26' are fitted with a shearing die-set composed of two identical die members 160,160', shown in FIG. 20. The shearing dies are orientated in a one over the other opposing manner so that the shear face 162 of each die is in sliding contact with the opposite die when the shearing actuators 26, 26' are activated in unison, as seen in FIG. 2. Since both of the opposing shearing dies 160,160' are identical only one die is shown in FIGS. 20-23 for descriptive purposes. The shearing dies are also cylindrical and have a stem portion 136 and a mushroom head 134 configured for sliding engagement with the "C" shaped slot 96 located in the connector member 94 at one end of the die. The opposite end of the die has a horizontal flat shearing face 162 representing the upper side of the shearing blade 168 extending the width of the die diameter and a vertical face 164 containing the orientation notch 144, seen in FIG. 20. The horizontal shearing face portion also has a "V" shape at its leading edge 166. Distance DI between the outermost points of the "V", shown in FIG. 21, is at least equivalent to the largest outside diameter of tubular to be engaged by the shearing dies 160. As seen in FIG. 22, the leading edge 166 is also has a beveled edge 170. A cavity 172 is machined below the shear blade 168 using a radius $R_1$ equivalent to one-half the diameter "D"$_1$ thereby producing the underside 172 of the shearing blade 168 with a cavity sufficient for a tubular being cut to pass and providing gusset supports 174 along each side of the shearing blade 168, as shown in FIG. 23. A tie-bar notch 146 and a threaded hole 148 are also provided, as shown in FIG. 22.

Figure 24:
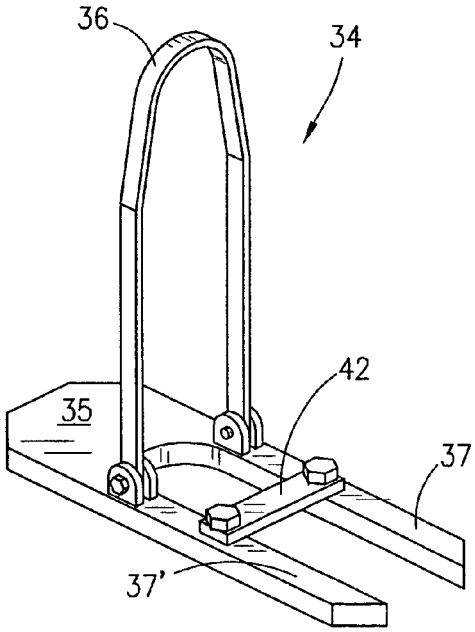
FIG. 24 is an isometric view of an embodiment of the casing-lifting fork.
Figure 25:
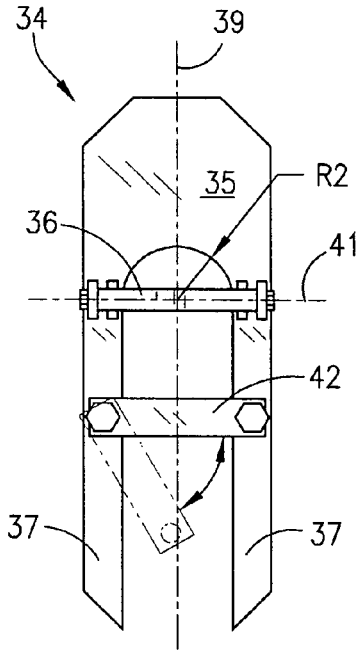
FIG. 25 is a top view of an embodiment of the casing-lifting fork.
Figure 26:
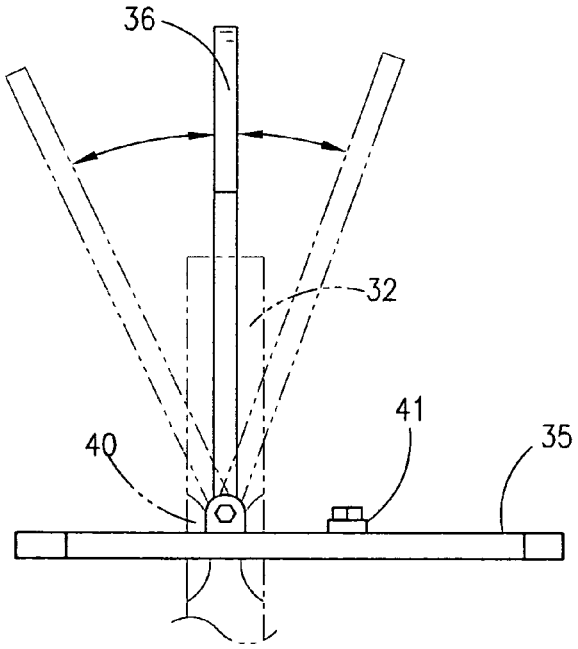
FIG. 26 is a side view of an embodiment of the casing-lifting fork.

Turning now to FIG. 24 wherein we see the fork assembly 34 includes an elongated plate 35 having an elongated slot defined by tines 37, 37' extending from one end of the plate along a longitudinal center line 39 seen in FIG. 25 culminating in a radii $R_2$ as also indicated in FIG. 17 as equivalent to the minor radii created by the indenting die 150 used for the size tubular to be lifted, using the balance point of plate 35 as a center line 41. A lifting bail 36 as seen in FIG. 26 is pivotally connected to the plate 35 along the balance point centerline 41. A safety bar 42 is also attached to each of the tines 37, 37' in front of the tubular being lifted to prevent accidental escape of the tubular 32 from the fork assembly 34 as shown in FIG. 26.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A tubular extraction system comprising:

a) a mounting;

b) a plurality of opposing actuators attached to said mounting;

c) a plurality of gripping, indenting and shearing assemblies attached to said actuators; and d) a means for engaging and lifting a string of tubular members insertable within mounting cooperative with indentations made by said indenting assemblies.

2. The tubular extraction system according to claim 1 wherein said mounting is located above a tubular string to be extracted.

3. The tubular extraction system according to claim 2 wherein said indenting assembly comprises a first and second opposing actuators having a tubular hub having a mounting flange portion and a central longitudinal through bore having internal threads at one end and a keyway, a cylindrical connector having a "C" shaped channel at each end slidable within said bore, a cylindrical head member having an external threads at each end and a central shoulder and a central through bore, threadably attached to said tubular hub, a connecting rod having a mushroom head at one end cooperative with said "C" shaped channel connected to said connector said rod slidable within said cylinder head member, an elongated tubular sleeve having internal threads at each end and external threaded fluid ports threadably connected at one end to said cylinder head member, a piston member having internal threads at one end and a central shoulder portion having a seal means said piston threadably connected to said connecting pin and slidable within said sleeve, an elongated cylindrical butt member externally threaded at one end threadably connected to said sleeve, each said actuator connected to a cylindrical die member slidable within said tubular hub having a stem portion and a mushroom shaped head portion at one end, an upper keyway, a lower tie-bar notch and tie bar, and a face opposite the stem portion having a vertical bore using said face as center for an upper and lower radii equal to one-half of the tubular outside diameter to be engaged by the die and a smaller radii located intermediate the upper and lower radii by said mushroom head slidably located within said "C" shaped channel and retained thereto by a connecting key.

4. The tubular extraction system according to claim 1 further comprising a wellhead attachment having a flanged adaptor spool, an adaptor member having a central opening and slots for adjustable attachment to said spool and said mounting.

5. The tubular extraction system according to claim 1 wherein said indenting assembly is located intermediate said gripping assembly and said shearing assembly.

6. The tubular extraction system according to claim 5 wherein said shearing assembly comprises a first and second opposing actuators having a tubular hub, a mounting flange portion and a central longitudinal through bore having an internal threads at one end and a keyway, a cylindrical connector having a "C" shaped channel at each end slidable within said bore, a cylindrical head member having an external threads at each end and a central shoulder and a central through bore, threadably attached to said tubular hub, a connecting rod having a mushroom head at one end cooperative with said "C" shaped channel connected to said connector said rod slidable within said cylinder head member, an elongated tubular sleeve having internal threads at each end and external threaded fluid ports threadably connected at one end to said cylinder head member, a piston member having internal threads at one end and a central shoulder portion having a seal means said piston threadably connected to said connecting pin and slidable within said sleeve, an elongated cylindrical butt member externally threaded at one end threadably connected to said sleeve, a cylindrical die member slidable within said tubular hub having a stem portion and a mushroom shaped head portion at one end, an upper keyway, a lower tie-bar notch and a shearing blade portion located opposite the stem portion having a horizontal face extending the width of the die diameter and a vertical face containing an orientation notch said shearing blade having a beveled "V" shape at a leading edge at least equivalent to the largest outside diameter of tubular to be engaged by the die member, said die member attached to said connector by said mushroom head slidably located within said "C" shaped channel and retained thereto by a connecting key.

7. The tubular extraction system according to claim 1 wherein means for lifting is a fork cooperative with indentations in an external surface of said tubular string member.

8. The tubular extraction system according to claim 7 wherein said fork comprises a bail attached thereto, the fork being slidable within said mounting for engagement with an indented portion of said tubular created by said indenting dies.

9. The tubular extraction system according to claim 8 wherein said fork comprises an elongated plate having an elongated slot extending from one end of said plate along a longitudinal center line to a radii equivalent to one-half the diameter of the tubular to be lifted using a balance point of said plate as center and a "V" shaped arm for said bail pivotally connected to said plate at said balance point.

10. The tubular extraction system according to claim 9 wherein said fork further comprises a pivotal safety bar extending across said slot.

11. The tubular extraction system according to claim 9 said lifting means further comprises a winch and cable system attachable to said fork for lifting said tubular members.

12. The tubular extraction system according to claim 1 wherein gripping assembly comprises:

a) a first actuator assembly comprising:

i) a tubular hub having a mounting flange portion and a central longitudinal through bore having an internal threads at one end and a keyway;

ii) a cylindrical connector having a "C" shaped channel at each end slidable within said bore;

iii) a cylindrical head member having an external threads at each end and a central shoulder and a central through bore threadably attached to said tubular hub;

iv) a connecting rod having a mushroom head at one end cooperative with "C" shaped channel connected to said connector said rod slidable within said cylinder head member;

v) an elongated tubular sleeve having internal threads at each end and external threaded fluid ports threadably connected at one end to said cylinder head member;

vi) a piston member having internal threads at each end and a central shoulder portion having a seal means said piston threadably connected to said connecting pin and slidable within said sleeve;

vii) an elongated cylindrical butt member externally threaded at one end and having a central longitudinal bore having internal seals at one end and threads at the opposite end said butt member threadably connected to said sleeve;

viii) a stop rod threadably attached to one end of said piston slidable within said butt member;

ix) a tee handle having a rod portion having external threads and a internal socket at one end and a transverse bar at the opposite end said rod portion threadably connected internally to said butt member with said socket engaging said stop rod;

x) a cylindrical gripping die member slidable within said tubular hub having a mushroom head at one end and "V" shaped jaws having teeth at the opposite end said jaws separated by a central channel said die member attached to said connector by said mushroom head slidably located within said "C" shaped channel and retained thereto by a connecting key; and b) a second opposing actuator assembly comprising elements i)-ix) and a cylindrical gripping die member slidable within said tubular hub having a mushroom head at one end and a single "V" shaped jaw having teeth at the opposite end said jaw cooperative with said channel located between said "V" shaped jaws of said element x) said die member attached to said connector by said mushroom head slidable located within said "C" shaped channel and retained thereto by a connecting key.

13. The tubular extraction system according to claim 1 further comprises a fluid pump and valve assembly for activating said actuators.

14. A method for extracting tubular members from a well in a plug and abandonment process comprising the steps of:

a) locating a mounting adjacent a tubular string to be extracted, said mounting comprising a plurality of opposing actuators attached to said mounting, a plurality of gripping, indenting and shearing assemblies attached to said actuators; and, a means for lifting a string of tubular members cooperative with indentions within a surface of said tubular members;

b) attaching a lifting apparatus to a tubular string and passing a portion of said tubular string between said opposing actuators to a point above said mounting;

c) engaging said tubular string by activating a set of said opposing actuators having attached gripping dies thereby retaining said tubular string in a suspended manner;

d) engaging said tubular string by activating a set of opposing actuators having attached shearing dies thereby severing a portion said tubular string below said engagement means;

e) engaging said tubular string by activating a set of opposing actuators having indenting dies attached located between said shearing dies and said gripping dies thereby forming an indentation within the surface of said tubular;

f) re-engaging said tubular string with said lifting apparatus thereby providing support for said tubular string;

g) disengaging said actuators having opposing gripping dies;

h) activating said lifting apparatus and lifting said tubing string to a desired height above said wellhead structure;

i) repeating steps c)-e); and j) laying down a portion of said tubing string supported by said lifting apparatus and repeating step f) and repeating steps c)-h) until said tubular string is extracted.

15. The method according to claim 14 further comprising the step of securing a safety bar on said lifting apparatus to prevent accidental disengagement.

16. The method according to claim 14 further comprising the step of blocking retraction of said actuators having opposing gripping assemblies by manually rotating a stop screw handle.

17. The tubular extraction system comprising:

a) a first mounting structure;

b) a first tubular gripping actuator attached to said first mounting structure;

c) a first tubular shearing actuator attached to said first mounting structure;

d) a first tubular indenting actuator attached to said first mounting structure;

e) a second mounting structure, said second mounting structure being spaced apart and connected to said first mounting structure;

f) a second tubular gripping actuator attached to said second mounting structure;

g) a second tubular shearing actuator attached to said second mounting structure; and h) a second tubular indenting actuator attached to said second mounting structure.

18. The tubular extraction system according to claim 17 wherein said first tubular indenting actuator is located between said first tubular gripping actuator and said first tubular shearing actuator, and said second tubular indenting actuator is located between said second tubular gripping actuator and said second tubular shearing actuator.

19. The tubular extraction system according to claim 18 wherein said first and second tubular indenting actuators further comprise interchangeable indenting dies located at an end of said first and second tubular indenting actuators.

20. The tubular extraction system according to claim 19 wherein said first and said second tubular shearing actuators further comprise interchangeable shearing dies located at an end of said first and second tubular shearing actuators.

21. The tubular extraction system according to claim 20 wherein said first and said second tubular gripping actuators further comprise interchangeable gripping dies located at an end of said first and second tubular indenting actuators.

22. The tubular extraction system according to claim 21 further comprising:

a) a means for cooperating with indentions in a tubular; and b) a lifting apparatus connected to said means for cooperating with indentions in a tubular.

23. A method for extracting a tubular string from a well comprising the steps of:

a) gripping the tubular;

b) indenting the tubular, whereby indentions are formed in the tubular;

c) shearing the tubular;

d) attaching a means for cooperating with the indentions in the tubular to the indentions in the tubular;

e) ungripping the tubular; and f) lifting the tubular.

24. The method of extracting a tubular string from a well according to claim 23 further comprising the additional steps of:

a) laying down a portion of the tubular string;

b) detaching said means for cooperating with the indentions in a tubular; and c) repeating steps a-f of claim 23, and steps a-b of claim 24, until the tubular string is extracted from the well.

* * * * *